United States Patent [19]

Weston

[11] 3,989,215

[45] Nov. 2, 1976

[54] MEANS FOR FIXING ARTICLES OF WALL FURNITURE TO WALLS

[76] Inventor: Peter William Weston, 19 Wilmington Close, Hassocks, Sussex, England

[22] Filed: Jan. 2, 1976

[21] Appl. No.: 646,392

[30] Foreign Application Priority Data

Jan. 7, 1975 United Kingdom ..... 591/75

[52] U.S. Cl. ..... 248/224; 312/245

[51] Int. Cl.[2] ..... F16M 13/00

[58] Field of Search ..... 248/223, 224, 225, 489, 248/494; 108/152; 312/245

[56] References Cited

UNITED STATES PATENTS

| | | | |
|---|---|---|---|
| 1,446,302 | 2/1923 | Henry | 248/224 X |
| 1,908,147 | 5/1933 | Hoegger | 248/489 |
| 2,162,887 | 6/1939 | Hart | 108/152 X |
| 2,570,731 | 10/1951 | Susnow | 248/247 |
| 2,848,880 | 8/1958 | Riedel | 312/245 X |
| 3,165,287 | 1/1965 | Parsons | 248/494 X |
| 3,427,086 | 2/1969 | Acton | 312/245 |

*Primary Examiner*—William H. Schultz
*Attorney, Agent, or Firm*—Berman, Aisenberg & Platt

[57] ABSTRACT

Means for mounting and locating an article of wall furniture in which a bar having lugs fixed to it is attached to the wall by the use of vertical slots in each lug to allow vertical adjustment, an upper part of each lug being bent outwardly to stand clear of the wall and being provided with a set screw. Two mounting members are fixed to the article each comprising a bracket formed to an inverted U-shape, the length of each set screw being such that it will just fit between the arms of the U-shape, the article being mounted by placing the members over the lugs so that the arms of the U-shape engage the ends of the set screw, the top of the article being adjustable towards and away from the wall by altering the positions of the set screws.

5 Claims, 6 Drawing Figures

MEANS FOR FIXING ARTICLES OF WALL FURNITURE TO WALLS

This invention relates generally to wall furniture such as wall cabinets, shelves, bookcases, cupboards, desks, bed headboards, mirrors, panels and other articles which are designed to be, or can be, attached to and suspended from a wall. More particularly the invention relates to means for firmly and adjustably attaching such articles to the wall.

Difficulty is often experienced in mounting articles of furniture etc. on walls, especially when such articles are heavy, for example wall desks, or are liable to have a considerable weight placed upon them or in them, for example television receivers. Another problem arises in levelling such articles, particularly when they are to be levelled and aligned with other articles, for example, a line of cabinets and cupboards which are to be fixed side by side to a wall, especially if the wall is somewhat curved vertically or horizontally, or twisted, that is, not quite flat. The principal object of the invention is to provide a simple and effective means for mounting such articles on the wall, which means is simple in conception, so that the articles may readily be accurately mounted without requiring professional assistance.

The invention consists of means for mounting an article of wall furniture comprising a wall mounting member in the form of a bar having mounting lugs fixed to it at or near its ends to lie against a wall, a vertical slot passing through each lug and the bar by which the lugs and bar may be fixed to the wall, an upper part of each lug being bent outwardly so that it stands away from the wall and being provided with a set screw, and two mounting members for the article each comprising a bracket formed to an inverted U-shape and having means for fixing it to the article, the length of the set screw being such that it will just fit between the arms of the U-shape, the mounting of the article being carried out by placing the members over the lugs so that the arms of the U-shape engage the ends of the set screw, the top of the article being adjustable towards and away from the wall by altering the position of the set screw.

Each bracket may be in the form of a length cut from extruded material of appropriate section.

Each of the lugs may have a fixing hole in addition to the slot and each article mounting member may have upwardly projecting barbs which penetrate the material of the article to provide additional strength and firmness to the location of the mounting member.

A preferred embodiment of the invention will now be described with reference to the accompanying drawings in which.

Figure 1:
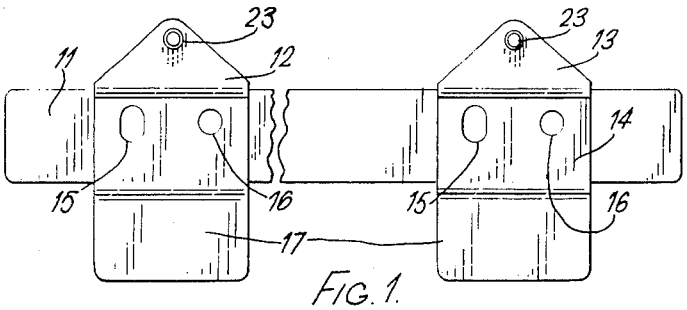
FIG. 1 is a front elevation of a wall mounting member comprising a bar with two lugs fixed to it adjacent its ends.
Figure 2:
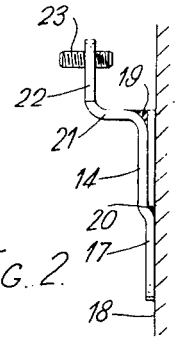
FIG. 2 is an end elevation of the wall mounting member of FIG. 1.

Referring to FIGS. 1 and 2, a wall mounting member according to the invention comprises a bar 11 having lugs, respectively 12 and 13, fixed to it near its ends. Conveniently the bar 11 and the lugs 12 and 13 are made of steel and the lugs are welded to the bar. Each lug has a front or central portion 14 which lies on the front surface of the bar 11, and a vertical slot 15 and a circular hole 16 pass through the lug and the bar. The lower part 17 of each lug 12 or 13 is bent inwardly so that it lies flush against the wall surface which is indicated at 18 in FIG. 2. The lugs may conveniently be welded to the bar at points indicated at 19 and 20. The upper part of each lug 12 or 13 is bent outwardly from the wall at 21 and upwardly at 22, the upper portion being cut away to form an inverted V-shape. Near the top of each portion 22 a set screw or screwed rod 23 is engaged in a screw-threaded hole.

In mounting the wall mounting member on a wall, holes are drilled and plugged so that screws passed through the slots 15 may be screwed into the plugged holes. The slots allow some adjustment of the relative heights of the ends of the bar 11 so that the bar 11 is quite level. If desired, one screw can be placed through the hole 16 in one lug and a screw may be used in the slot 15 of the other lug. This will provide a more limited adjustment of the level of the bar 11. As a further possibility, screws may be passed through the slots 16 in both lugs and when the bar 11 has been levelled further screws may be passed through the holes in both lugs, which are already fixed by means of their slots. This will ensure that the bar cannot shift when a heavy article is later placed upon the lugs.

Figure 3:
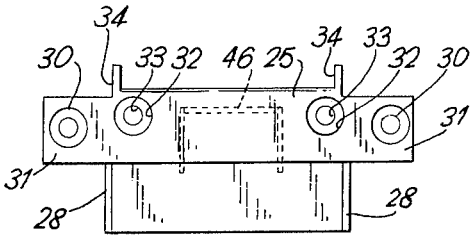
FIG. 3 is a side elevation of an article mounting member.
Figure 4:
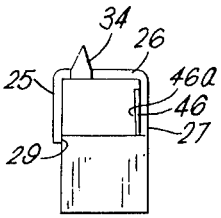
FIG. 4 is an end elevation of the article mounting member of FIG. 3.

FIGS. 3 and 4 show a side elevation and an end elevation respectively of the article mounting member, two of which are to be attached to the article to be mounted, the horizontal spacing apart being equal to the spacing of the lugs 12 and 13 on the bar 11. It should here be pointed out that although FIG. 3 has been described as a front elevation, this relates to the member itself, but when it is mounted at the rear of the article of furniture the front elevation of the mounting member is seen when looking at the rear surface of the article of furniture with the mounting member in position.

The mounting member is made from sheet metal, preferably sheet steel, but it could be made from extruded section. It is formed to a U-shape, having a front arm 25, an upper wall 26, and a rear and longer arm 27. The rear arm 27 has its ends bent forward to form two side pieces 28 and where these make contact with the front arm 25, that is, at points 29, the parts may be tack welded. The front arm 25 terminates in two lugs 31 which are formed with counter-sunk holes 30 near their ends so that counter-sunk screws may be used to secure the lugs 31 to the rear of the article. The front arm 25 is also formed with two large holes 32 and the rear arm 27 is formed with two small holes 33, in alignment with the holes 32, so that an alternative form of mounting screws may be screwed through the holes 33 into the back of the article, the large holes 32 enabling the screws to be inserted through the front arm of the member and also allowing entry of a screwdriver. In order to strengthen the location of the article mounting member with respect to the article two projections are formed on the ends of the upper wall 26 and these are turned upwardly to form barbs 34 which are driven into the article. A narrow slot is formed at 46 in the front arm 25 of the article mounting member and the tongue formed thereby is pushed inwards slightly at 46*a* to form a spring or wedge which bears on one end of the set screw 23. This helps to resist pressure tending to lift the article.

Figure 5:
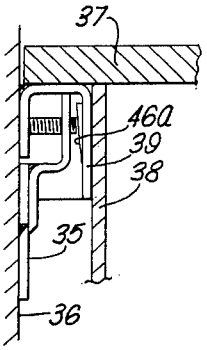
FIG. 5 shows the mounting of a cabinet using the elements illustrated in FIGS. 1 to 4.

FIG. 5 shows how the wall mounting member and the article mounting member are assembled. The bar 11 and the lugs 12 and 13 have been fixed in position on the wall, and the complete wall mounting member is generally indicated at 39 and it is attached to the back 38 of the cabinet by screws (not shown) which pass through the back 38 into fillets secured by screws and glue. The set screws 23 are screwed outwardly (away from the wall) to a sufficient extent to allow the front arm 25 of the article mounting member to pass into position so that the upper wall 26 of each article mounting member rests on the top of the respective lug of the wall mounting member. The set screws 23 are then adjusted (by temporarily lifting the cabinet from the wall mounting member) so that the front wall 25 of the article mounting member is against or spaced from the wall 36 by a desired distance. The cabinet 37 may be adjusted laterally along the wall surface to ensure that it is in the correct position.

Figure 6:
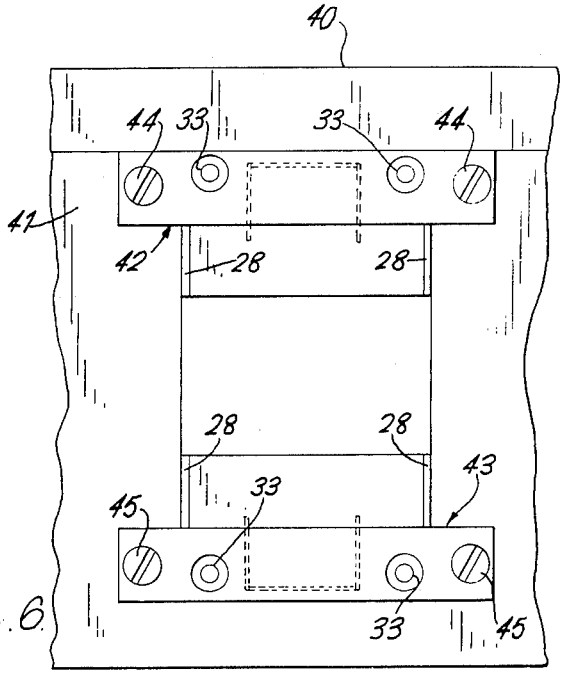
FIG. 6 is a rear view of a shelf with an apron showing two of the article mounting members of FIGS. 3 and 4 mounted in the apron.

FIG. 6 shows a rear view of a shelf 40 attached to an apron 41. The rear face of the apron 41 is cut away to allow the entry of two article mounting members indicated respectively at 42 and 43. These members 42 and 43 are mounted in inverted relation with respect to each other so that when the wall mounting member (not shown) has been fixed in position the shelf and its apron may be mounted either way up, that is to say, with the shelf 40 above the apron 41 as shown in the Figure or in the inverted position with the apron 41 above the shelf 40. The two article mounting members are secured to the apron by screws 44 and 45 respectively.

I claim:

1. Means for mounting an article of wall furniture comprising a wall mounting member in the form of a bar having mounting lugs fixed to it at or near its ends to lie against a wall, a vertical slot passing through each lug and the bar by which the lugs and bar may be fixed to the wall, an upper part of each lug being bent outwardly so that it stands away from the wall and being provided with a set screw, and two mounting members for the article each comprising a bracket formed to an inverted U-shape and having means for fixing it to the article, the length of the set screw being such that it will just fit between the arms of the U-shape, the mounting of the article being carried out by placing the members over the lugs so that the arms of the U-shape engage the ends of the set screw, the top of the article being adjustable towards and away from the wall by altering the position of the set screw.

2. Means as claimed in claim 1 in which each bracket is in the form of a length cut from extruded material of appropriate section.

3. Means as claimed in claim 1 comprising a fixing hole in each of the lugs and the bar in addition to the slot.

4. Means as claimed in claim 1 in which each article mounting member comprises upwardly projecting barbs which penetrate the material of the article to provide additional strength and firmness to the location of the article mounting member.

5. Means as claimed in claim 1 in which each article mounting member has a front arm, comprising a narrow slot in the front arm of each article mounting member, the tongue formed thereby being pushed inwards to form a spring or wedge which bears on one end of the set screw.

* * * * *